US008652262B2

(12) United States Patent
Hasegawa et al.

(10) Patent No.: US 8,652,262 B2
(45) Date of Patent: Feb. 18, 2014

(54) ULTRASONIC CLEANING METHOD FOR GENERATING ULTRASONIC VIBRATIONS BY A FREQUENCY MODULATED SIGNAL

(71) Applicants: Hiroshi Hasegawa, Tokyo (JP); Tomoharu Kamamura, Tokyo (JP); Yasuhiro Imazeki, Tokyo (JP)

(72) Inventors: Hiroshi Hasegawa, Tokyo (JP); Tomoharu Kamamura, Tokyo (JP); Yasuhiro Imazeki, Tokyo (JP)

(73) Assignee: Kaijo Corporation, Tokyo (JP)

( * ) Notice: Subject to any disclaimer, the term of this patent is extended or adjusted under 35 U.S.C. 154(b) by 0 days.

(21) Appl. No.: 13/661,694

(22) Filed: Oct. 26, 2012

(65) Prior Publication Data

US 2013/0048013 A1 Feb. 28, 2013

Related U.S. Application Data

(62) Division of application No. 12/531,178, filed as application No. PCT/JP2008/053552 on Feb. 28, 2008, now abandoned.

(30) Foreign Application Priority Data

Mar. 14, 2007 (JP) ..... 2007-065620

(51) Int. Cl.
*B08B 3/04* (2006.01)

(52) U.S. Cl.
USPC ..... 134/1; 134/1.3; 134/42; 134/902

(58) Field of Classification Search
USPC ..... 134/1, 1.3, 42, 902
See application file for complete search history.

(56) References Cited

U.S. PATENT DOCUMENTS

| | | | | |
|---|---|---|---|---|
| 4,736,130 | A | 4/1988 | Puskas | |
| 5,379,785 | A | 1/1995 | Ohmori et al. | |
| 5,715,851 | A | 2/1998 | Jung et al. | |
| 5,911,232 | A | 6/1999 | Mokuo et al. | |
| 6,276,370 | B1 * | 8/2001 | Fisch et al. | 134/1.3 |
| 2012/0174943 | A1 * | 7/2012 | Sinha | 134/1 |

FOREIGN PATENT DOCUMENTS

| | | | |
|---|---|---|---|
| JP | 63-036534 | A | 2/1988 |
| JP | 02-063580 | A | 3/1990 |
| JP | 07-289991 | A | 11/1995 |
| JP | 08-131978 | A | 5/1996 |
| JP | 09-047733 | A | 2/1997 |
| JP | 10-135176 | A | 5/1998 |

OTHER PUBLICATIONS

English language International Search Report dated Apr. 1, 2008, issued in counterpart Application No. PCT/JP2008/053552.

* cited by examiner

*Primary Examiner* — Bibi Carrillo
(74) *Attorney, Agent, or Firm* — Holtz, Holtz, Goodman & Chick, PC

(57) ABSTRACT

An ultrasonic cleaning method of using ultrasonic vibrations to clean an object that is immersed in a cleaning liquid in a cleaning tank is provided. The method includes generating a frequency modulated signal including at least two frequency modulated portions having modulation widths different from each other with a single frequency as a center frequency, such that among the at least two frequency modulated portions a frequency modulated portion having a smaller modulation width is generated at a timing when a frequency modulated portion having a larger modulation width reaches the center frequency. The method further includes generating the ultrasonic vibrations based on the frequency modulated signal and transferring the ultrasonic vibrations to the cleaning tank to clean the object.

17 Claims, 8 Drawing Sheets

(a)

(b)

(a)

(b)

ULTRASONIC CLEANING METHOD FOR GENERATING ULTRASONIC VIBRATIONS BY A FREQUENCY MODULATED SIGNAL

This is a Divisional of U.S. application Ser. No. 12/531,178, filed Sep. 14, 2009 now abandoned , which is a U.S. National Phase Application under 35 USC 371 of International Application PCT/JP2008/053552, filed Feb. 28, 2008.

TECHNICAL FIELD

The present invention relates to an ultrasonic cleaning apparatus configured to remove fine dust (particles) or the like adhered to electronic components using signals whose frequencies are varied and, more specifically, to a ultrasonic cleaning apparatus using high-frequency signals equal to or higher than 100 kHz.

BACKGROUND ART

In the related art, in a manufacturing process of electronic components, various ultrasonic cleaning apparatuses using ultrasonic vibrations for cleaning surfaces of the electronic components as objects to be cleaned are proposed as means for removing dusts (particles) such as fine refuses or dirt adhered to the electronic components such as semiconductor wafers, hard disks, glass substrates.

As an example of the ultrasonic cleaning apparatus, there is an apparatus having a two-tank structure in which a cleaning tank includes an outer tank and an inner tank to be arranged in the outer tank. This apparatus has a configuration in which the inner tank formed of quartz or the like and the outer tank formed of metallic material such as stainless or resin material and provided with a transducer mounted thereon are provided for preventing adhesion of eluted metallic ion on the object to be cleaned when metal is used for the cleaning tank.

Also, medium liquid for propagating the ultrasonic vibrations generated by driving an ultrasonic transducer to cleaned member immersed in cleaning liquid stored in the inner tank is stored in the outer tank. The inner tank is arranged in the outer tank in a state in which a bottom plate thereof is soaked in the medium liquid. In the ultrasonic cleaning apparatus in the configuration as described above, the object to be cleaned immersed in the cleaning liquid in the inner tank is cleaned using the ultrasonic vibrations generated by oscillating the transducer by predetermined signals.

In order to generate the ultrasonic vibrations, signals of a single frequency or frequency modulated signals are generally used. The high-frequency signals of a single frequency are configured to provide signals of a constant frequency to the transducer to generate the ultrasonic vibrations.

The ultrasonic cleaning apparatuses in which the frequency modulated high-frequency signals are applied are disclosed in Patent Documents 1 and 2, although they are not the cleaning tanks having a two-tank structure as described above. FIG. 8 is a cross-sectional view of the ultrasonic cleaning apparatus in Patent Document 1 viewed from the front. An ultrasonic cleaning apparatus 301 includes a cleaning tank having a single tank structure having a bottom plate 307 on which a plurality of transducers 309 are fixed. It has a configuration to provide frequency modulated high-frequency signals at a predetermined modulation width to the respective transducers 309 in order to solve the variation in oscillating performance among the plurality of transducers 309.

Patent Document 2 is an ultrasonic cleaning apparatus having two oscillators for generating ultrasonic vibrations. The respective oscillators are configured to generate the ultrasonic vibrations at frequencies different from each other by frequency modulated high-frequency signals to solve nonuniformity of the sound pressure in the cleaning tank.

[Patent Document 1] JP-A-63-36534

[Patent Document 2] JP-A-8-131978

DISCLOSURE OF INVENTION

Problems to be Solved by the Invention

When a cleaning operation is performed with the ultrasonic cleaning apparatus having the two-tank structure using the above-described single frequency, the cleaning at the frequency suitable for the cleaning is efficiently achieved. However, there is a risk of variations in sound pressure from area-to-area in the inner tank depending on the positional relation between the bottom plate of the outer tank and the bottom plate of the inner tank, variations in shape of the bottom plate or in vibrating properties of the transducers, or mounting accuracy of the transducers. Consequently, the yield of the cleaning process is lowered.

In order to solve deficiencies on the basis of the signals of the single frequency, an ultrasonic cleaning apparatus having the two-tank structure using the high-frequency signal according to the frequency modulation disclosed in Patent Document 1 or Patent Document 2 is also contemplated. By performing the frequency modulation, even when the bottom plate of the inner tank is arranged in an inclined position with respect to the bottom plate of the outer tank on which the transducers are mounted in order to let out air bubbles in the outer tank, when the bottom plates are not arranged in parallel due to the distortion of the bottom plate (vibrating plate) of the outer tank or the bottom plate of the inner tank, or when the mounting accuracy of the transducer is not very high, the nonuniformity of the sound pressure in the inner tank is prevented by using the frequency modulated signals with a predetermined center frequency.

However, when the above-described frequency modulated high-frequency signals are used, the driving time at the center frequency becomes shorter per unit time, so that the average sound pressure per unit time with respect to the object to be cleaned is lowered. Consequently, the cleaning effect of the object to be cleaned is lowered in comparison with the single frequency. Therefore, in order to increase the average sound pressure per unit time, it is contemplated to increase the amplitude (power) of the signals. However, portions of the object to be cleaned which are satisfactorily cleaned even before increasing the amplitude of the signals are subjected to application of excessive sound pressure, so that the object to be cleaned might be broken.

Accordingly, it is an object of the present invention to provide an ultrasonic cleaning apparatus having a high cleaning efficiency by restraining lowering of the sound pressure applied to the object to be cleaned per unit time while securing the uniformization of the sound pressure in the entire area within the cleaning tank.

Means for Solving the Problems

In order to solve the above-described problems, an ultrasonic cleaning apparatus according to the present invention includes ultrasonic vibration generating means configured to generate a frequency modulated signal and generate ultrasonic vibrations; and a cleaning tank configured to store cleaning liquid in which the object to be cleaned is to be immersed in the interior thereof and clean the object to be cleaned by ultrasonic vibrations generated by the ultrasonic vibration generating means, in which the signal includes at least two frequency modulated portions having modulation widths different from each other with a single frequency as a center frequency.

According to the ultrasonic cleaning apparatus in the present invention, the cleaning tank includes an outer tank having the ultrasonic vibration generating means mounted thereon for storing a transfer medium for transferring the ultrasonic vibrations, and an inner tank arranged inside the outer tank for cleaning the object to be cleaned immersed in the cleaning liquid stored therein by the ultrasonic vibrations transferred via the transfer medium.

Furthermore, according to the ultrasonic cleaning apparatus in the present invention, a bottom plate of the inner tank is inclined by a predetermined angle with respect to a bottom plate of the outer tank.

According to the ultrasonic cleaning apparatus in the present invention, the at least two frequency modulated portions having the modulation widths different from each other are different in oscillating time thereof according to cleaning condition.

According to the ultrasonic cleaning apparatus in the present invention, the frequency modulated portion having a small modulation width of the at least two frequency modulated portions is generated at a timing when the frequency modulated portion having a large modulation width reaches the center frequency.

In addition, according to the ultrasonic cleaning apparatus in the present invention, the transfer medium is pure water or chemical solution.

According to the ultrasonic cleaning apparatus in the present invention, the ultrasonic vibration generating means includes a single or a plurality of transducers.

According to the ultrasonic cleaning apparatus in the present invention, the ultrasonic vibration generating means includes a single or plurality of oscillating units and power amplifiers.

In the present invention, in the case of the cleaning tank having a single tank structure, quartz glass is preferably used for the cleaning tank. In the case of the cleaning tank having a two-tank structure, stainless, plastic or the like may be used as a material of the outer tank, and quartz glass, polypropylene, fluorine-based resin, alumina or the like may be used as a material of the inner tank having a resistance against heat or chemical solution. As the cleaning liquid, hydrogen peroxide, ammonium, pure water, a substance formed of hydrogen peroxide-hydrochloric acid-pure water, hydrogen fluoride-nitric acid-pure water, and so on may be used. As a material of the transducer, SUS, tantalum, molybdenum, titanium, tungsten, and so on may be used.

Advantages

In the present invention, signals having two frequency modulated portions are used. Therefore, uniformization of the sound pressure in the entire area within the cleaning tank is achieved by the frequency modulated portion having a large modulation width. Therefore, as a consequence, cleaning nonuniformity on the object to be cleaned arranged in the cleaning tank is prevented.

In addition, although the cleaning time at the center frequency which provides a good cleaning efficiency is reduced by the provision of the frequency modulated portion having a large modulation width, lowering of the average sound pressure per unit time which occurs from said reduction of the cleaning time at the center frequency is restrained by the provision of the frequency modulated portion having a small modulation width.

In this manner, the present invention provides the ultrasonic cleaning apparatus having a high cleaning efficiency by restraining lowering of the sound pressure applied to the object to be cleaned per unit time while securing the uniformization of the sound pressure in the entire area within the cleaning tank.

REFERENCE NUMERALS

Figure 1:
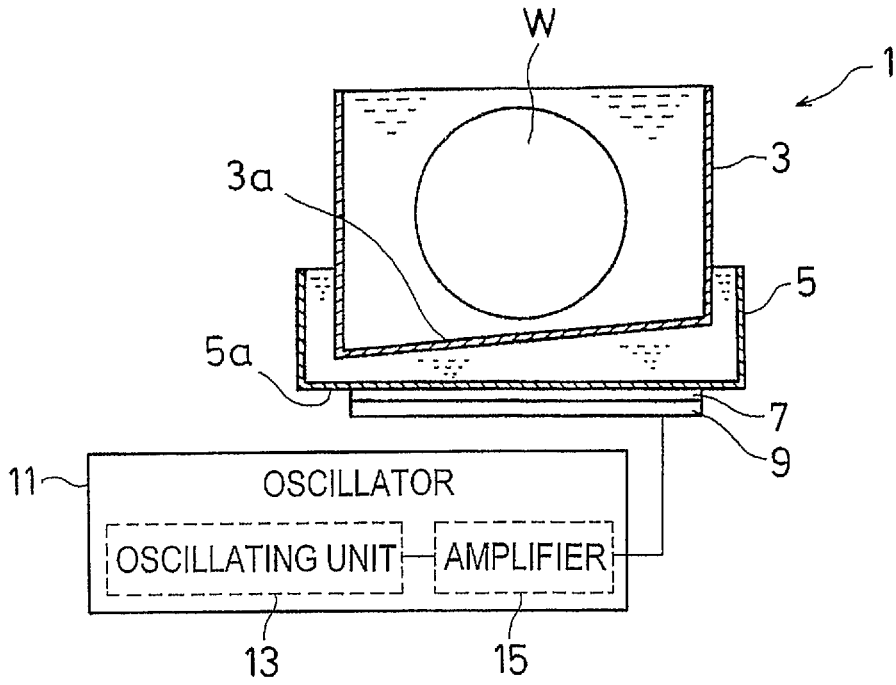
FIG. 1 is a cross-sectional view of an ultrasonic cleaning apparatus according to an embodiment of the present invention viewed from the front.

1 ultrasonic cleaning apparatus
2 inner tank
3*a* bottom plate of the inner tank
5 outer tank
5*a* bottom plate of the outer tank
7 vibrating plate
9 transducer
11 oscillator
13 oscillating unit
15 power amplifier
w object to be cleaned (wafer)

BEST MODES FOR CARRYING OUT THE INVENTION

Referring now to the drawings, an embodiment of an ultrasonic cleaning apparatus according to the present invention will be described.

Figure 2:
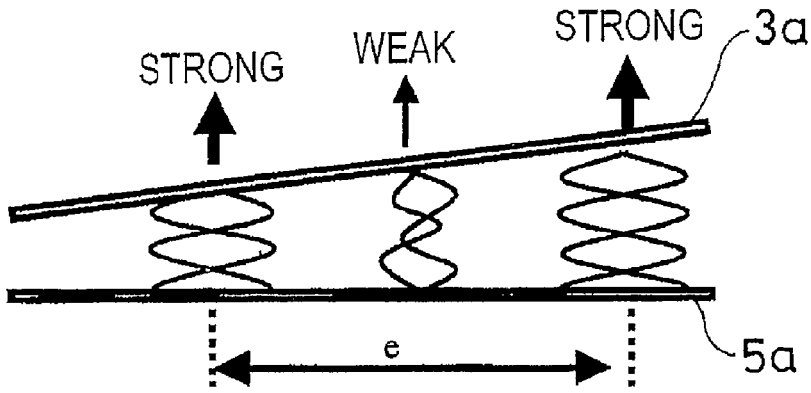
FIG. 2(*a*) is a diagrammatic sketch showing standing waves generated by a predetermined frequency, and FIG. 2(*b*) is a diagrammatic sketch showing a state in which a standing wave is moved by frequency modulation.
Figure 2:
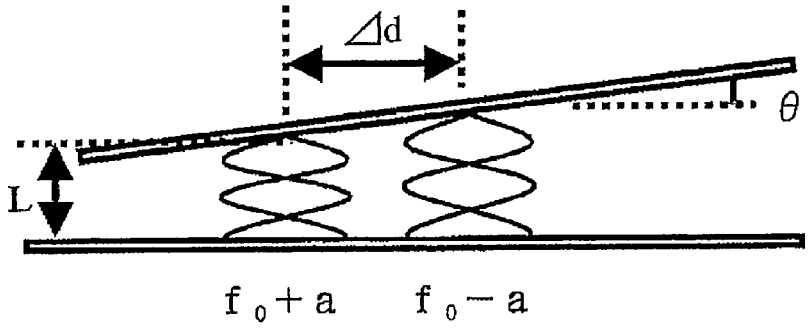
Figure 3:
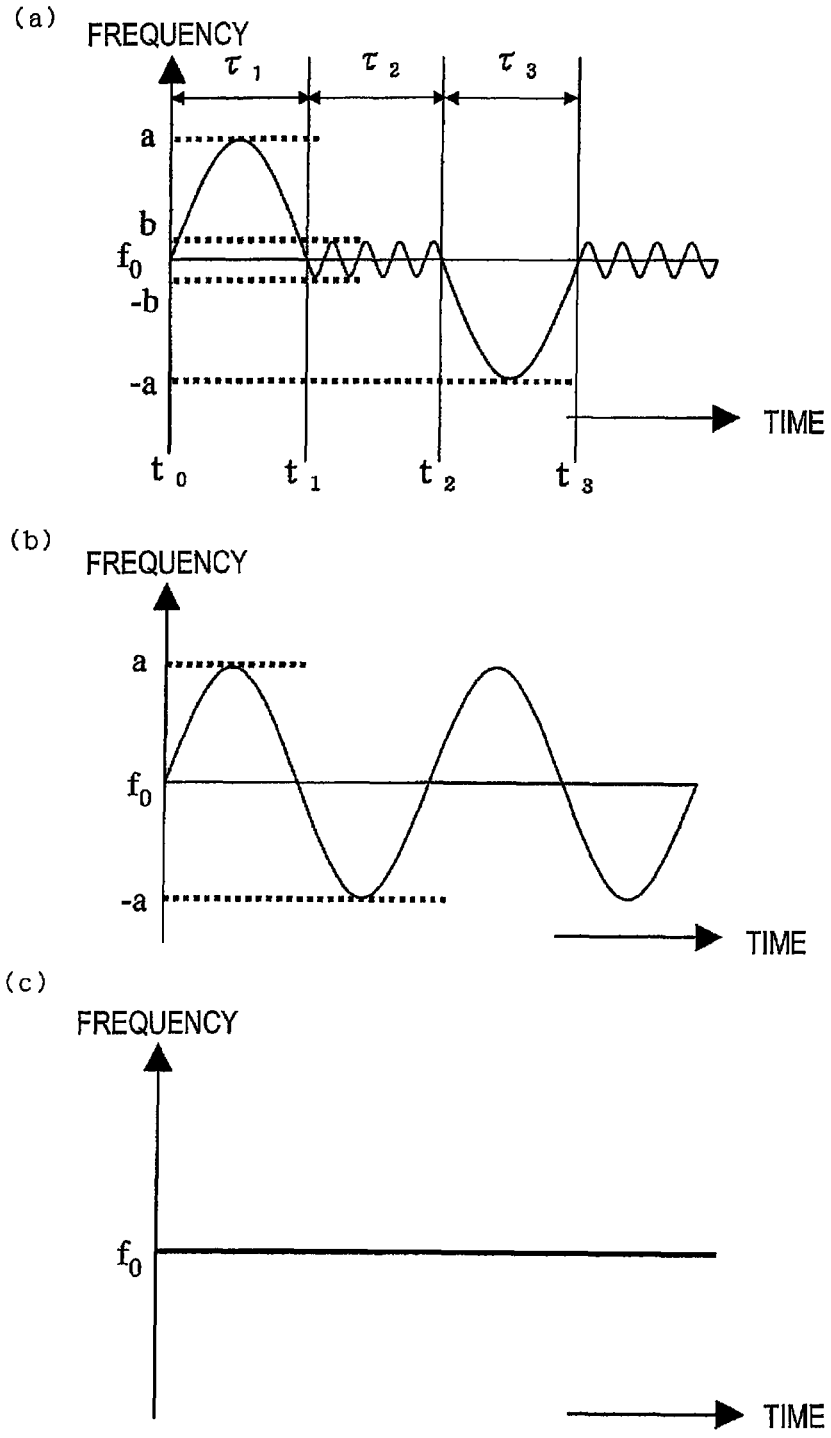
FIG. 3 is a frequency variation diagram showing the frequency by the vertical axis and the time by the lateral axis, in which (a) is a drawing showing a frequency variation in the present invention, (b) is a drawing showing a frequency variation in FM modulation, and (c) is a drawing showing a case of a single frequency.
Figure 4:
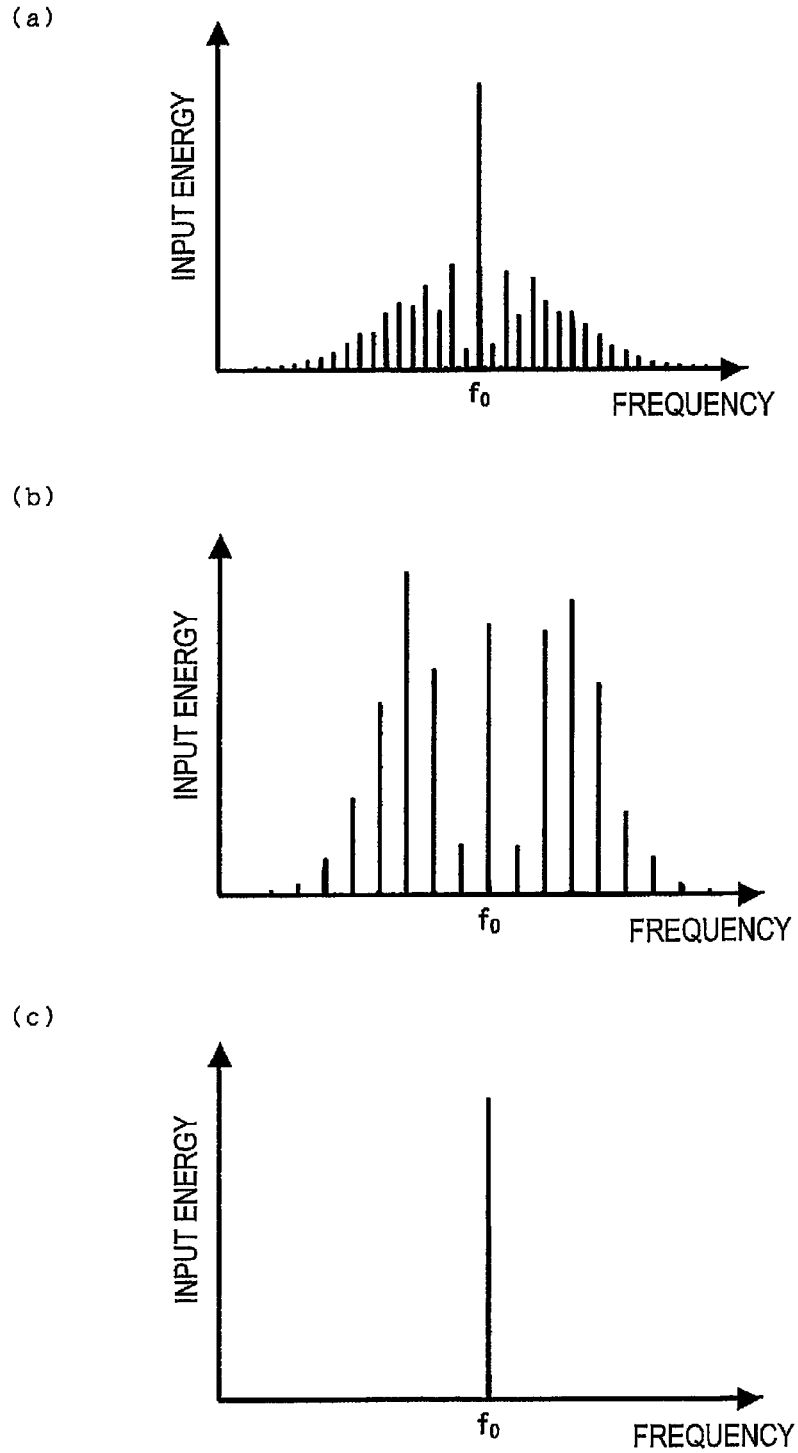
FIG. 4 is a graph showing distribution of signal components obtained by measuring respective signals shown in FIG. 3 by a spectrum analyzer, in which (a) is a distribution of the frequency in the present invention, (b) is a distribution of the frequency in the FM modulation, and (c) is a distribution of the single frequency.
Figure 5:
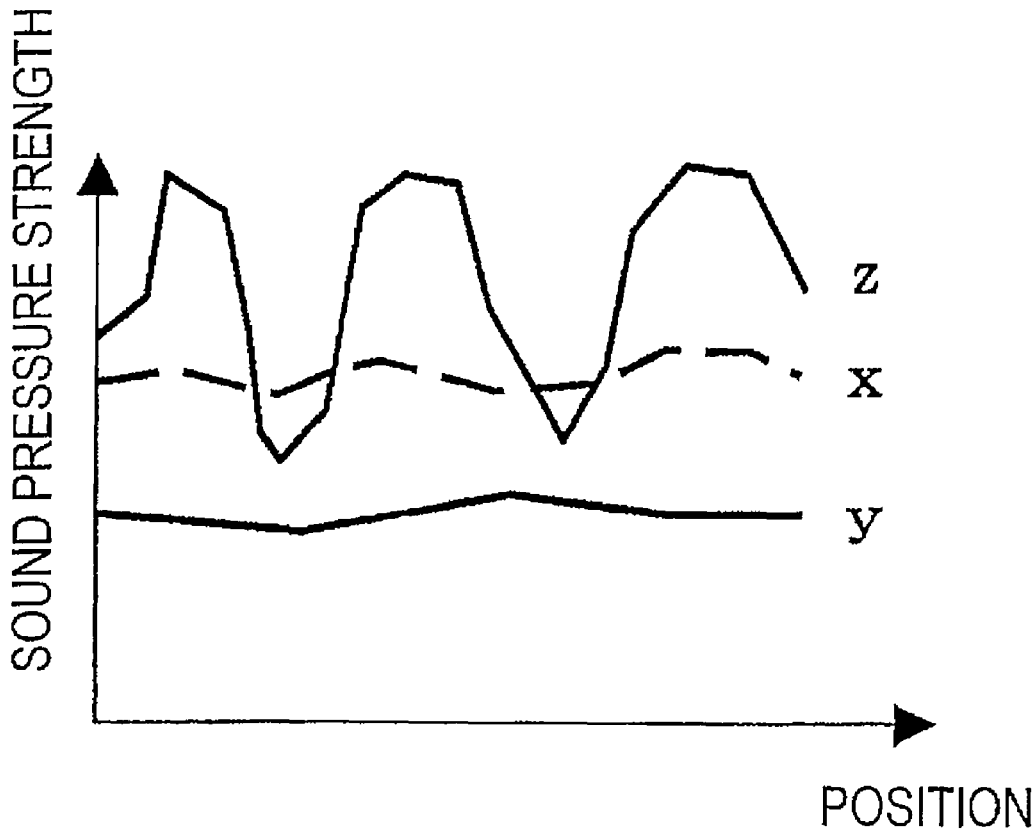
FIG. 5 is a graph showing the strength of the sound pressure at a predetermined depth from an opening of an inner tank.

FIG. 1 is a cross-sectional view of the ultrasonic cleaning apparatus according to the embodiment of the present invention when viewed from the front. FIG. 2(*a*) is a diagrammatic sketch showing standing waves generated by a predetermined frequency (single frequency), and FIG. 2(*b*) is a diagrammatic sketch showing a state in which a standing wave is moved by frequency modulation. FIG. 3 is a frequency variation diagram showing the frequency by the vertical axis and the time by the lateral axis, in which (a) is a drawing showing a frequency variation in the present invention, (b) is a drawing showing a frequency variation in FM modulation, and (c) is a drawing showing a case of a single frequency. FIG. 4 is a graph showing distribution of signal components obtained by measuring respective signals shown in FIG. 3 by a spectrum analyzer, in which (a) is a distribution of the frequency of the present invention, (b) is a distribution of the frequency in the related art, and (c) is a distribution of the single frequency. FIG. 5 is a graph showing the strength of the sound pressure at a predetermined depth from an opening of an inner tank.

An ultrasonic cleaning apparatus 1 in the present invention has a two-tank structure having an inner tank 3 and an outer tank 5 as shown in FIG. 1. The inner tank 3 is a cleaning tank for cleaning an object to be cleaned, and has an opened upper end and an inclined bottom plate 3*a*. In the inner tank 3, cleaning liquid for cleaning an object to be cleaned w is stored.

When ultrasonic vibrations are provided to pure water or the like in the outer tank 5 described above, air component dissolved in the pure water or the like appears as air bubbles and the air bubbles may be adhered to the bottom plate 3*a* of the inner tank 3. When the air bubbles are adhered, the ultrasonic waves are hardly propagated into the interior of the inner tank 3. Therefore, the bottom plate 3*a* is inclined to allow the air bubbles adhered to the bottom plate 3*a* to leave easily.

The outer tank 5 is an indirect tank configured to transfer the ultrasonic vibrations from the ultrasonic vibration generating means indirectly to the inner tank 3. The outer tank 5 has an opened upper end, and stores pure water, chemical solution or the like in the interior thereof as a transfer medium. The ultrasonic vibration generating means which generates ultrasonic vibrations is connected to a bottom plate 5*a* of the outer tank 5. The bottom plate 5*a* of the outer tank 5 is a substantially horizontal plane. Therefore, since the bottom plate 3*a* of the inner tank is inclined at a predetermined angle with respect to the horizontal direction, the bottom plate 3*a* of the inner tank 3 is arranged at a predetermined angle with respect to the bottom plate 5*a* of the outer tank 5.

The ultrasonic vibration generating means includes a vibrating plate 7 to be fixed to the bottom plate 5*a* of the outer tank 5, a transducer 9 configured to transfer ultrasonic vibrations to the vibrating plate 7, and an oscillator 11 configured to generate the ultrasonic vibrations. The oscillator 11 includes an oscillating unit 13 and a power amplifier 15. The oscillating unit 13 generates high-frequency signals having at least two frequency modulated portions having different modulation widths with a predetermined single frequency as a center frequency. The high-frequency signals are amplified by the power amplifier 15 and entered into the transducer 9.

When the ultrasonic vibrations entered into the transducer 9 are provided to pure water or the like as the transfer medium via the vibrating plate 7, the standing waves are formed between the bottom plate 3*a* of the inner tank 3 and the transducer 9. The standing waves are sonic waves formed by overlapping of incoming waves from the vibrating plate 7 and reflected waves propagated through the transfer medium in the outer tank 5, impinged on the bottom plate 3*a* of the inner tank 3 and reflected therefrom. As in the present embodiment, when the bottom plate 3*a* of the inner tank 3 and the bottom plate 5*a* of the outer tank 5 are inclined, the distance between the bottom plate 5*a* of the outer tank 5 and the inclined bottom plate 3*a* of the inner tank 3 changes along the inclination, so that the sound pressure incoming into the bottom plate 3*a* of the inner tank 3 varies according to the position of the bottom plate 3*a* of the inner tank 3.

Referring to FIGS. 2(*a*) and (*b*), the standing waves generated in the ultrasonic cleaning apparatus will be described. The bottom plate 3*a* of the inner tank 3 is inclined with respect to the bottom plate 5*a* of the outer tank 5 extending in the horizontal direction. A pitch e of the standing wave in this case is expressed by;

$$e=v/(2\cdot f\cdot\tan\theta) \qquad \text{expression (1)}$$

where v is a sound velocity, f is a center frequency, θ is an inclined angle (inclination) of the bottom plate 3*a* of the inner tank 3.

In order to make sound pressure of the standing waves uniform, the standing wave is moved by frequency modulation of the standing waves to counterbalance the high and low sound pressures. Now, the extent of movement of the standing waves needs to be taken into consideration. The width of movement of the standing wave is expressed by;

$$\Delta d=(2\cdot f\cdot L)/\{(f-\Delta f)\tan\theta\} \qquad \text{expression (2).}$$

Here, Δf is a modulation width, L is a vertical distance from the bottom plate 3*a* of the inner tank 3 at a predetermined position of the bottom plate 5*a* of the outer tank 5.

For example, when the frequency is 2 MHz, the angle of inclination is 2 degrees, the pitch e at which the standing wave is generated is 10.7 mm on the bottom plate 5*a* of the outer tank 5 from the expression (1).

Therefore, if the standing wave is successfully moved by the same extent as the pitch e of the standing wave or more, the nonuniformity of the sound pressure (sound pressure strips) caused by the inclination of the bottom plate of the inner tank is resolved. Assuming that the modulation width is frequency-modulated at 20 kHz, the width of movement Δd of the standing wave is 17.4 mm on the bottom plate 3*a* of the inner tank 3 from the expression (2). In other words, the sound pressure nonuniformity (sound pressure strips) is resolved.

Subsequently, the high-frequency signals relating to the frequency modulation used in this embodiment will be described. As shown in FIG. 3(*a*), the high-frequency signals in the embodiment includes the first modulated portion having a center frequency of $f_0$ and a frequency deviation of ±a (that is, the modulation width is 2*a*) and the second modulated portion having a center frequency of $f_0$ and a frequency deviation of ±b (the modulation width is 2*b*). Here, a frequency deviation a is larger than the frequency deviation b.

The so-called FM-modulated signals in the related art has a center frequency $f_0$ as a predetermined frequency and a frequency deviation of ±a, as shown in FIG. 3(*b*). Therefore, the signal of the present invention shown in FIG. 3(*a*) has a waveform obtained by adding the signals in FIG. 3(*b*) to another frequency modulated portion having a different modulating width. For better understanding of the characteristics of the high-frequency signals according to this embodiment, a signal at a single frequency in the related art is shown in FIG. 3(*c*). As a matter of course, since the single frequency signal is not frequency-modulated, it is represented by a straight line passing through the center frequency $f_0$.

In addition, as shown in FIG. 3(*a*), the high-frequency signal in this embodiment is a signal obtained by combining the first modulated portion having the frequency deviation of ±a and the second modulated portion having a frequency deviation of ±b continuously. In FIG. 3(*a*), for example, with reference to a certain time point, from $t_0$ to $t_1$ (predetermined time interval τ1) is modulated from the center frequency $f_0$ to a maximum frequency $f_0$+a, and to the center frequency $f_0$. Then, from $t_1$ to $t_2$ (predetermined time interval τ2) is a signal of the second modulated portion. Furthermore, from $t_2$ to $t_3$ (predetermined time interval τ1) is modulated from the center frequency $F_0$ to a maximum frequency $f_0$−a, and to the center frequency $f_0$.

In this case, the predetermined time intervals τ1, τ2, and τ3 may be the same pitches, or the oscillating times of the first modulated portion and the second modulated portion may be changed so as to match the object to be cleaned or the cleaning conditions. For example, when increasing the sound pressure in the center frequency $f_0$, the oscillating time relating to the second modulated portion is elongated, and when improving the uniformity of the sound pressure in the entire area within the cleaning tank, the oscillating time relating to the first modulated portion is elongated on the contrary. Therefore, being different from FIG. 3(*a*), various combinations such that the signal is modulated continuously from the maximum frequency $f_0$+a directly to the minimum frequency $f_0$−a, or from the minimum frequency $f_0$−a to the maximum frequency $f_0$+a, and then is modulated continuously to the center frequency (the first modulated portion) and then is transferred to the second modulated portion are considered.

In FIG. 3(*a*), the signal is transferred from the first modulated portion to the second modulated portion or from the second modulated portion to the first modulated portion at timing when reaching the center frequency $f_0$. Assuming that this configuration is employed, such an event that the object to be cleaned fails to stand a repeated abrupt change in frequency at a modulation width 2*a* of the first modulated portion in association with further downsizing and thickness reduction of the electronic component in the future is prevented, even though it is the frequency change due to the frequency modulation to a negligible extent for the current object to be cleaned. In other words, the object to be cleaned is prevented from becoming damaged by the abrupt frequency change at the modulation width 2*a* of the first modulated portion by sandwiching the second modulated portion of only a modulation width 2*b*, so that the abrupt frequency change is avoided and the object to be cleaned is prevented from becoming damaged.

Subsequently, the distribution of the signal components of the high-frequency signal used in the cleaning apparatus 1 will be described in comparison with the high-frequency signal and the single frequency signal in the related art. In the graph in FIG. 4, the vertical axis represents the input energy as a magnitude of the signal component and a lateral axis represents the frequency.

First of all, since the single frequency signal shown in FIG. 4(*c*) only has a center frequency $f_0$ component, the peak is at the center frequency, so that a distribution in which other frequency components do not exist is assumed. Therefore, when the bottom plate 3*a* of the inner tank 3 is inclined at a predetermined angle with respect to the bottom plate 5*a* of the outer tank 5 as in the case of the ultrasonic cleaning apparatus 1, the sound pressure in the inner tank 3 becomes nonuniform.

As shown in FIG. 4(*b*), the signal component in the frequency modulation in the related art includes the signal components over the entire modulation width, and hence the unevenness of the signal component is relatively small. However, a peak of a specific signal component does not exist. From this reason, it is understood that the oscillation with the signal component at the center frequency $f_0$, which is the most suitable for cleaning, is not secured sufficiently.

It is understood that the high-frequency signal in the embodiment shown in FIG. 4(*a*) provides a significantly large amount of the component at the center frequency $f_0$ in comparison with other frequency components as shown in FIG. 4(*a*) while securing the frequency components over the entire modulation widths of the frequency modulated portions as shown in FIG. 4 (*b*). Therefore, even though the bottom plate 3*a* of the inner tank 3 is inclined at a predetermined angle with respect to the bottom plate 5*a* of the outer tank 5 as in the case of the ultrasonic cleaning apparatus 1, the sound pressure in the inner tank 3 may be uniformized and, since the peak is at the center frequency $f_0$, it is understood that the optimal frequency component is sufficiently secured.

Although the magnitudes of the signal components at the center frequencies $f_0$ in the graphs of FIGS. 4(*a*) and (*b*) appear not to be too much different, it is because the scales of the vertical axes in FIGS. 4(*a*) and (*b*) are differentiated. Therefore, it does not mean that the actual signal components of the center frequencies $f_0$ in FIGS. 4(*a*) and (*b*) are the same. If the scales of the vertical axes of FIGS. 4(*a*) and (*b*) is equalized, the difference among the signal components at the respective frequencies cannot be apparent in the case of FIG. 4(*b*), so that the characteristics of the distribution do not appear apparently. Therefore, the scales are differentiated to an extent which makes the characteristics of the distribution apparent.

Subsequently, the distribution of the sound pressure strength in the inner tank 3 of the cleaning apparatus 1 will be described in comparison with the related art. In the graph in FIG. 5, the vertical axis represents the sound pressure strength and the lateral axis represents the horizontal position of the inner tank 3 at a predetermined water depth. Reference sign x is a graph of a frequency modulated signal in the embodiment, y is a graph of a frequency modulated signal in the related art, and z is a graph of a single frequency signal.

As is clear from the drawing, the nonuniformity of the sound pressure is very significant in the case of the single frequency z in the same plane in the horizontal direction in the cleaning liquid. In contrast, at the frequency y in the related art, it is understood that the sound pressure is uniformized, but the sound pressure is relatively low. At the frequency x in the embodiment, it is understood that uniformization of the sound pressure may be brought into the same level as the frequency y in the related art, and the further uniformization is realized in comparison with the single frequency z. In addition, in the case of the frequency modulated signal x in this embodiment, although the sound pressure is lower than the single frequency signal z, but is further higher in comparison with the frequency modulated signal y in the related art, and hence restraint of the lowering of the sound pressure is achieved.

Figure 6:
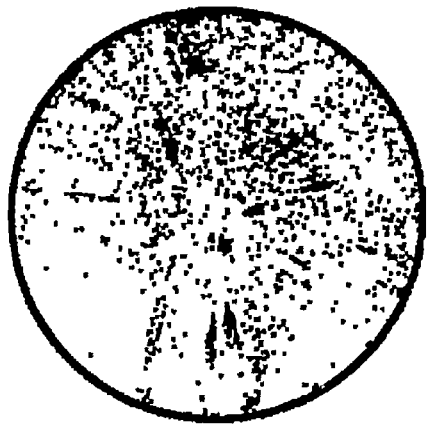
FIG. 6 shows the surface of an object to be cleaned (wafer) cleaned using the ultrasonic cleaning apparatus, in which (a) shows a result obtained when the frequency modulated signal in this embodiment is used, and (b) shows a result obtained when the single frequency is used.
Figure 6:
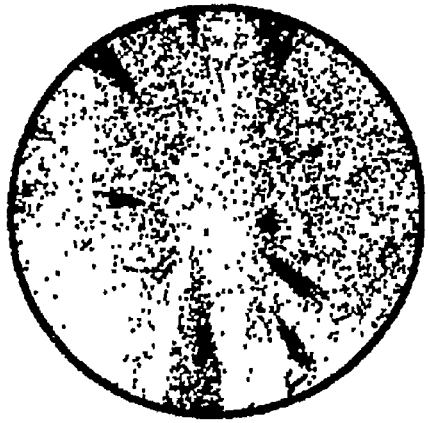

Subsequently, the results of a case in which the wafer actually adhered with dust (particles) is cleaned by immersing in the inner tank are shown. FIG. 6 shows the surface of the wafer cleaned using the ultrasonic cleaning apparatus, in which (a) shows a result obtained when the frequency modulated signal in this embodiment is used, and (b) shows a result obtained when the single frequency signal is used. In FIG. 6, the black portion indicates dusts (particles) adhered to the surface of the wafer after having cleaned.

In comparison with the wafer in FIG. 6(*b*), it is understood that dusts (particles) are removed substantially uniformly over the entire area of the wafer shown in FIG. 6(*a*). In addition, the dusts (particles) are adhered in a stripe pattern in FIG. 6(*b*). In other words, it is understood that the sound pressure was not uniform in the inner tank in FIG. 6(*b*). On the other hand, as shown in FIG. 6(*a*), when the frequency modulation is performed, the dusts (particles) adhered in the stripe pattern is reduced in comparison with FIG. 6(*b*).

Figure 7:
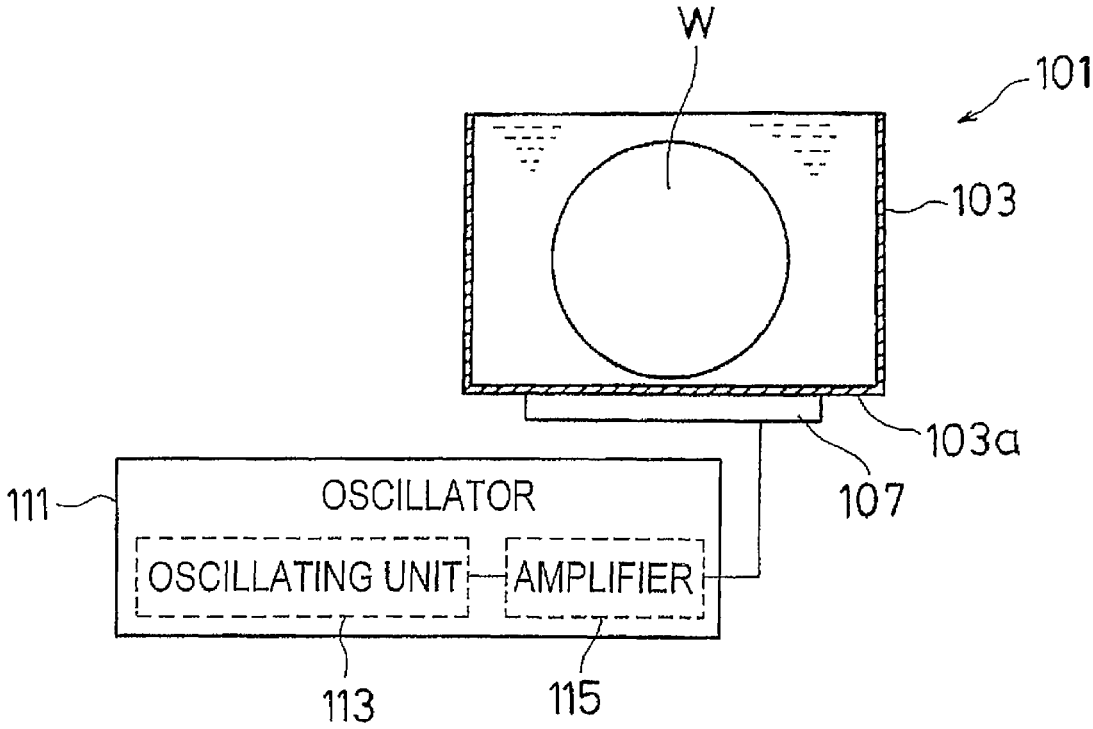
FIG. 7 is a cross-sectional view of an ultrasonic cleaning apparatus 101 according to a modified embodiment of the present invention when viewed from the front.
Figure 8:
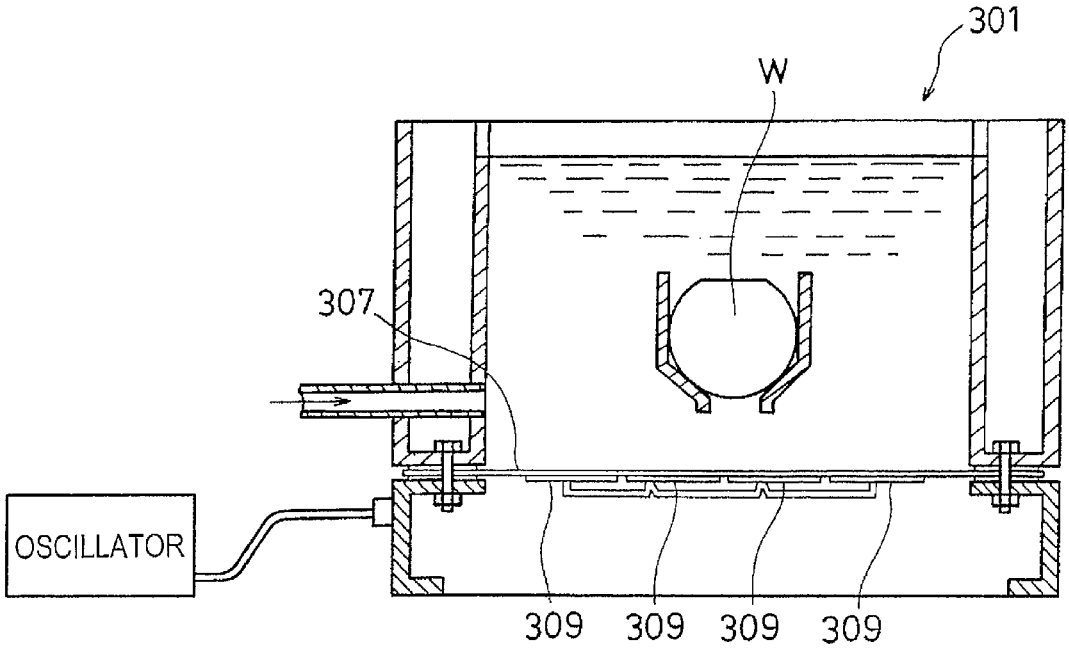
FIG. 8 is a cross-sectional view of an ultrasonic cleaning apparatus in the related art when viewed from the front.

The ultrasonic cleaning apparatus of the two-tank structure has been described in the embodiment shown above, the present invention is not limited to this structure. As a modification, an ultrasonic cleaning apparatus 101 including a single ultrasonic vibration generating means in a single cleaning tank 103 as shown in FIG. 7 is exemplified. The vibration generating means includes a transducer 107 adhered directly to a bottom plate 103*a* of the cleaning tank 103 and an oscillator 111 configured to provide the high-frequency signal which is the same as in this embodiment to the transducer 107. The oscillator 111 includes an oscillating unit 113 and a power amplifier 115 as in this embodiment.

In addition, in this modification, the sound pressure in the entire area in the cleaning tank 103 is uniformized by the first modulated portion of a large modulation width, and in addition, prevention of lowering of the sound pressure per time at the center frequency by the second modulated portion of a small modulation width is achieved, even when the bottom plate 103*a* of the cleaning tank 103 is distorted and hence the liquid surface of the cleaning liquid is not parallel to the bottom plate 103*a*, or even when the bonding error of the transducer 107 occurs.

Also, although the high-frequency signal in the embodiment has a waveform having the two frequency modulated portions having different modulation widths, a waveform having three or more different frequency modulated portions having frequency widths different from each other is also applicable.

In the embodiment or the modification, the center frequency is not described in detail. However, when the center frequency is set to be several MHz, the modulation width of the first modulated portion is on the order of several tens kHz and the modulation width of the second modulated portion is preferably on the order of 1 kHz or smaller.

The invention is implemented in various modes without departing the essential feature of the invention. Therefore, the embodiment described above is illustrative only and, needless to say, the present invention is not limited thereto.

What is claimed is:

1. An ultrasonic cleaning method of using ultrasonic vibrations to clean an object that is immersed in a cleaning liquid in a cleaning tank, the method comprising:

generating a frequency modulated signal including at least two frequency modulated portions having modulation widths different from each other with a single frequency as a center frequency, such that among the at least two frequency modulated portions a second frequency modulated portion having a smaller modulation width is generated at a timing when a first frequency modulated portion having a larger modulation width reaches the center frequency; and generating the ultrasonic vibrations based on the frequency modulated signal and transferring the ultrasonic vibrations to the cleaning tank to clean the object.

2. The ultrasonic cleaning method according to claim 1, wherein an oscillating period of each of the at least two frequency modulated portions is set in accordance with the object to be cleaned.

3. The ultrasonic cleaning method according to claim 1, wherein the first frequency modulated portion having the larger modulation width is continuously modulated from the center frequency to the center frequency via a maximum frequency or a minimum frequency.

4. The ultrasonic cleaning method according to claim 1, wherein the cleaning tank includes an inner tank that contains the cleaning liquid, and an outer tank in which the inner tank is arranged;

wherein the method comprises transferring the ultrasonic vibrations to the inner tank by a transfer medium stored in the outer tank; and wherein a bottom plate of the inner tank is inclined by a predetermined angle with respect to a bottom plate of the outer tank.

5. The ultrasonic cleaning method according to claim 1, wherein the ultrasonic vibrations are generated using at least one transducer.

6. The ultrasonic cleaning method according to claim 1, wherein the frequency modulated signal is generated using at least one oscillating unit and at least one amplifier.

7. The ultrasonic cleaning method according to claim 2, wherein the cleaning tank includes an inner tank that contains the cleaning liquid, and an outer tank in which the inner tank is arranged;

wherein the method comprises transferring the ultrasonic vibrations to the inner tank by a transfer medium stored in the outer tank; and wherein a bottom plate of the inner tank is inclined by a predetermined angle with respect to a bottom plate of the outer tank.

8. The ultrasonic cleaning method according to claim 2, wherein the ultrasonic vibrations are generated using at least one transducer.

9. The ultrasonic cleaning method according to claim 2, wherein the frequency modulated signal is generated using at least one oscillating unit and at least one amplifier.

10. The ultrasonic cleaning method according to claim 3, wherein the cleaning tank includes an inner tank that contains the cleaning liquid, and an outer tank in which the inner tank is arranged;

wherein the method comprises transferring the ultrasonic vibrations to the inner tank by a transfer medium stored in the outer tank; and wherein a bottom plate of the inner tank is inclined by a predetermined angle with respect to a bottom plate of the outer tank.

11. The ultrasonic cleaning method according to claim 3, wherein the ultrasonic vibrations are generated using at least one transducer.

12. The ultrasonic cleaning method according to claim 3, wherein the frequency modulated signal is generated using at least one oscillating unit and at least one amplifier.

13. The ultrasonic cleaning method according to claim 4, wherein the transfer medium is pure water or a chemical solution.

14. The ultrasonic cleaning method according to claim 4, wherein the ultrasonic vibrations are generated using at least one transducer.

15. The ultrasonic cleaning method according to claim 4, wherein the frequency modulated signal is generated using at least one oscillating unit and at least one amplifier.

16. The ultrasonic cleaning method according to claim 7, wherein the transfer medium is pure water or a chemical solution.

17. The ultrasonic cleaning method according to claim 10, wherein the transfer medium is pure water or a chemical solution.

* * * * *